United States Patent [19]

Shattuck

[11] 4,024,368

[45] May 17, 1977

[54] SWITCH ASSEMBLY HAVING SELECTIVE ACTUATION SENSITIVITY

[75] Inventor: Ronald Corroalles Shattuck, Canoga Park, Calif.

[73] Assignee: Litton Systems, Inc., Beverly Hills, Calif.

[22] Filed: Oct. 2, 1975

[21] Appl. No.: 619,137

[52] U.S. Cl. ..... 200/314; 200/5 A; 200/340

[51] Int. Cl.² ..... H01H 3/12

[58] Field of Search ..... 340/365 R; 235/145 R; 200/308, 314, 340, 159 B, 5 A, 5 R

[56] References Cited

UNITED STATES PATENTS

| | | | |
|---|---|---|---|
| 3,800,104 | 3/1974 | Lien | 200/5 A |
| 3,870,840 | 3/1975 | Rivetta | 200/5 A |

*Primary Examiner*—Gerald P. Tolin

*Attorney, Agent, or Firm*—Donald J. Ellingsberg

[57] ABSTRACT

A switch assembly having a lighted display module for programmable character display where the module is an active part during switch actuation. The module has a force actuating line and is displaced by a predetermined portion of an applied switch actuating force because the module line for transmitting such force is selectively displaced from the line of the applied actuating force.

6 Claims, 7 Drawing Figures

Fig. 1
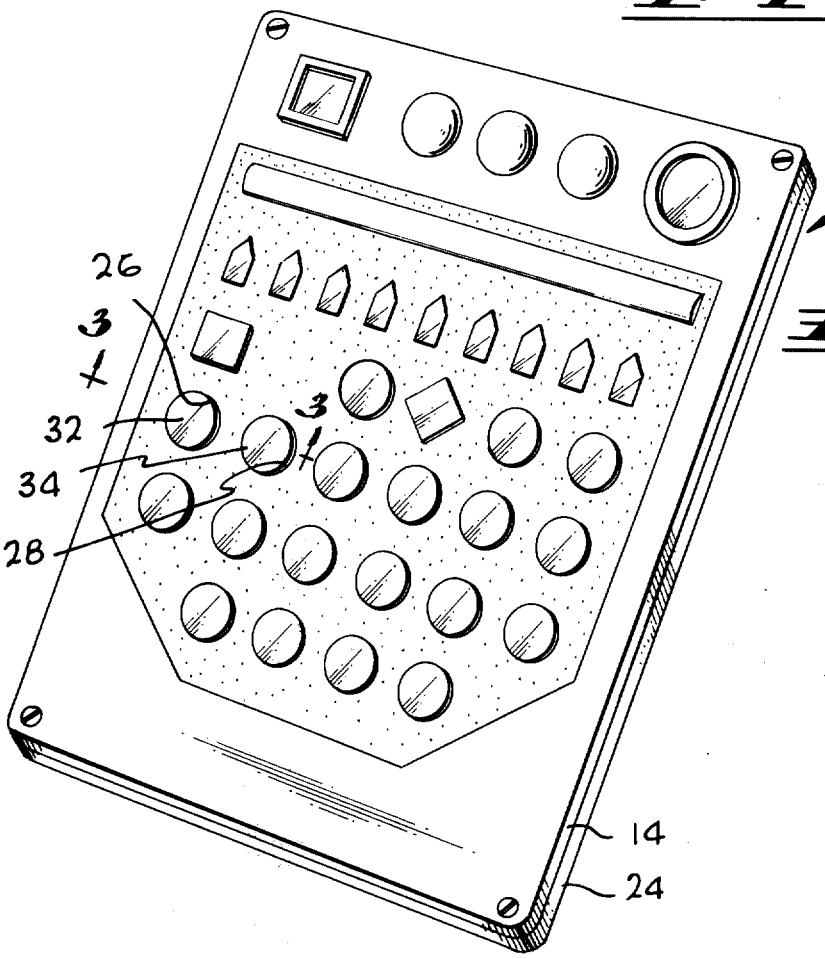
Fig. 4
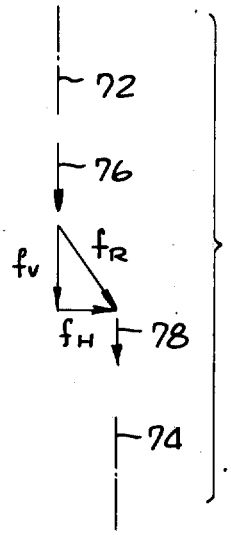
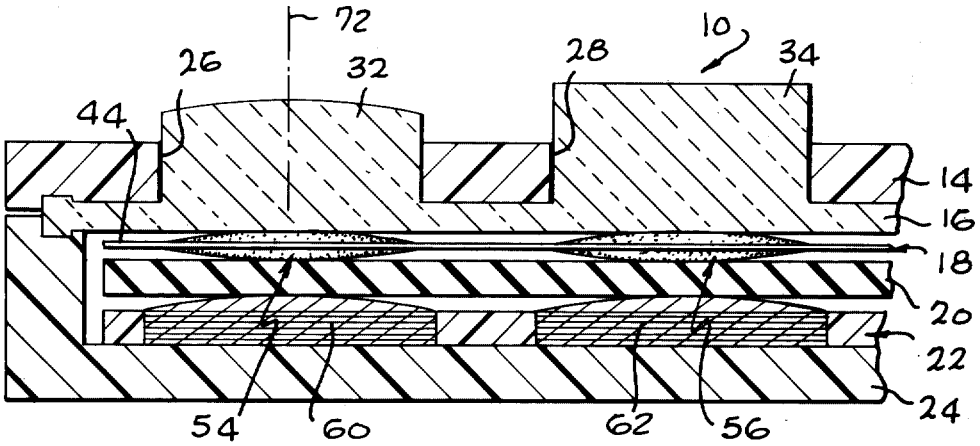
Fig. 2
PRIOR ART

Fig. 3
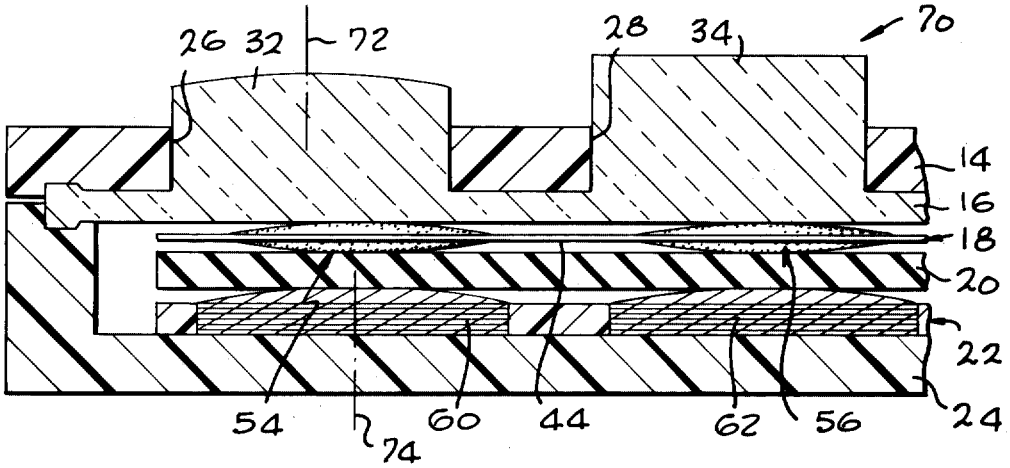
Fig. 5
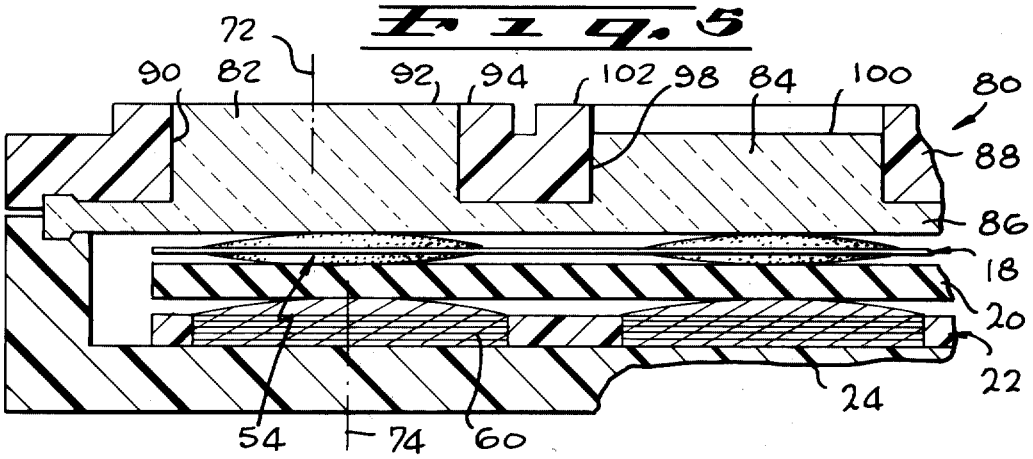
Fig. 6
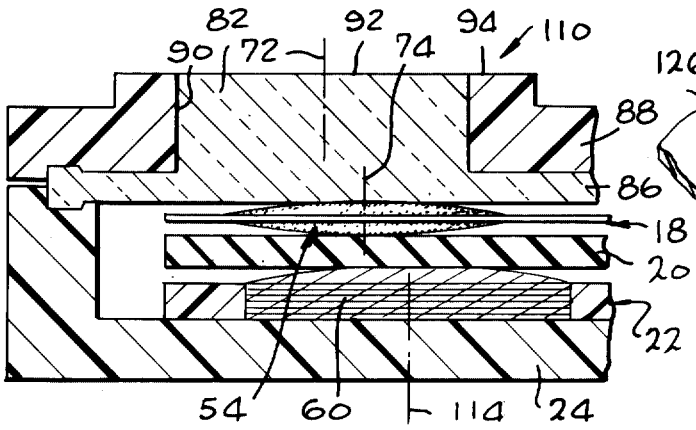
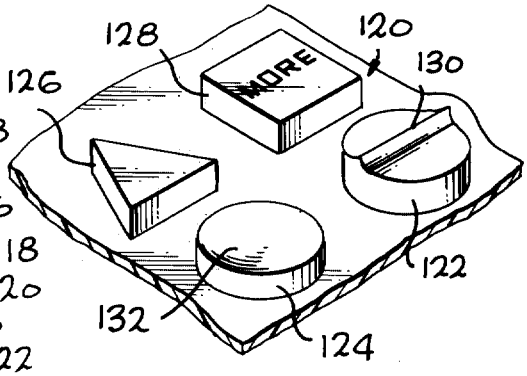
Fig. 7

SWITCH ASSEMBLY HAVING SELECTIVE ACTUATION SENSITIVITY

BACKGROUND OF THE INVENTION

Illuminated switch assemblies of various types are considered to be well known in the prior art. Among the various types are those switch assemblies that either project indicia from a plane behind the switch through the actual switch itself for viewing at the switch/switch panel assembly. U.S. Pat. No. 3,777,222 is considered to be one example of an indicating panel including a switch assembly that incorporates both principles of rear projection and through-the-switch illumination. In my copending application for a SWITCH ASSEMBLY, Ser. No. 585,203, filed June 9, 1975, and assigned to the assignee of the present application, the switch assembly includes the principle of through-the-switch illumination without the use of a membrane type switch (U.S. Pat. No. 3,732,389 is one example thereof). However, the actuating force applied to such a switch assembly in certain applications can result in damage to or destruction of the switch assembly components.

OBJECTS OF THE INVENTION

Accordingly, it is an object of the invention to provide a new and improved switch assembly having selective actuation sensitivity.

It is an object of the invention to provide a switch assembly for illumination of displaceable indicia during switch actuation by the indicia wherein the switch assembly has selective actuation sensitivity.

It is an object of the invention to provide a switch assembly having selective actuation sensitivity and illumination of displaceable indicia that substantially reduces the probability of damage to the displaceable indicia during switch actuation by the indicia.

SUMMARY OF THE INVENTION

Briefly, in accordance with the invention, a new and improved switch assembly is provided having a transparent force transmitting means such as a flexible keypad with transparent keys that define a key line for each key which, when a selected key is displaced by an actuating force, itself displaces a flexible indicator means that defines a flexible indicator line selectively aligned with or displaced from the key line, which displays indicia through the displaced key and where the indicia can be programmable, to operate a switch means that defines a switch line which, when the flexible indicator line is so displaced, can be selectively displaced from the flexible indicator line or can be common with the flexible indicator line, the switch means operates through an intermediate resilient means that absorbs a portion of the actuating force transmitted by the selectively displaced lines and further absorbs any rebound force developed by the switch means during its operation.

While the specification concludes with claims particularly pointing out and distinctly claiming the subject matter which may be regarded as the invention, the organization and method of operation, together with further objects, features, and the attending advantages thereof, may best be understood when the following description is read in connection with the accompanying drawing.

BRIEF DESCRIPTION OF THE DRAWINGS

FIG. 1 is a perspective view of the switch assembly of the invention in an operative unit.

FIG. 2 is an enlarged, sectional view of a PRIOR ART switch assembly that can find use in the operative unit.

FIG. 3 is an enlarged, sectional view, partly broken away, of the switch assembly along the line 3—3 of FIG. 1.

FIG. 4 is a vector representation of an actuating force transmitted by the switch assembly of FIG. 3.

FIG. 5 is an enlarged sectional view, partly broken away, of another switch assembly of the invention.

FIG. 6 is an enlarged sectional view, partly broken away, of another switch assembly of the invention.

FIG. 7 is an enlarged, prespective view, partly broken away of a keypad that can find use in the switch assemblies of the invention.

DESCRIPTION OF THE INVENTION

Referring to FIGS. 1 and 2, the switch assembly of the invention can find use in a portable interactive device 12 which can be hand-held computer with display. However, it is contemplated that the switch assembly can find use wherever there is a need for both an illuminated, programmable indicator and a control switch as an integral assembly.

In FIG. 2, the PRIOR ART switch assembly 10 includes several elements: a switch panel 14, a keypad 16, an indicator package 18, a cushion 20, a switch package 22, and a case or housing 24.

The switch panel 14, which is the cover for the case 24, is formed from a firm material with a plurality of selectively positioned apertures; for example, key apertures 26 and 28.

The keypad 16 is formed from a transparent, flexible, and readily moldable material which can be a conventional elastomer. Keycaps, such as keycaps 32 and 34, are molded at selected positions so that the respective keycaps, for example keycaps 32 and 34, extend outwardly through an associated key aperture, here key apertures 26 and 28. The keypad 16 can be either a clear, transparent member or a colored, transparent member.

The indicator package $18^1$ of FIG. 2 has a base plate 44 that is relatively thin and flexible with light emitting devices, which may or may not be programmable, positioned thereon and encapsulated in a transparent epoxy that, when suitably cured, forms a hard protective module such as modules 54 and 56 as illustrated by FIG. 2. Application by Ronald C. Shattuck, Ser. No. 585,204, filed June 9, 1975 and assigned to the assignee of the present application.

The cushion 20 as shown by FIG. 2 is selected to have a desired resiliency for the absorption of a portion of an operator induced force and for the dissipation of forces induced by other than an operator as described hereinafter.

A conventional switch package 22, which can be a plurality of dome switches, completes the switch assembly 10. In FIG. 2, the switch package has a dome switch 60 coactive with keycap 32 and programmable character display module 54, and a dome switch 62 coactive with keycap 34 and display module 56.

Operatively, the PRIOR ART switch assembly 10 is actuated by an applied actuating force which displaces, for example, keycap 34 from its non-actuating or rest position as illustrated by FIG. 2 and flexes the keypad 16. Since the encapsulated display module 56 is hard, the displaced keycap 34 transmits the actuating force to the module and displaces it while at the same time flexing the base plate 44 thereof. The displaced module 56 compresses the adjacent resilient cushion 20 which absorbs a portion of the thus transmitted actuating force. The remainder of the actuating force is transmitted by the cushion 20 which depresses the dome switch 62 into its actuate mode. The resiliency of the cushion 20 combined with the flexure both of base plate 44 and keypad 16, including the slight compressibility of keycap 34, restores the switch assembly 10 to its non-actuating or rest position when the actuating force is removed. Any "snap-back" force generated by the dome switch 62 when the actuating force is removed is absorbed and dissipated by the resilient cushion 20 so that damage to the display module 56 is avoided. Similarly, the resiliency of not only the cushion 20 but also the springiness of the material that forms the keypad 16 and its keycaps also prevents damage to the display module 56 during switch assembly actuation.

Referring to the remaining FIGS., wherein like parts in FIGS. 1 and 2 are hereinafter identified by the same reference character, one form of switch assembly 70 of the invention is shown by FIG. 3. In the switch assembly 70, a keycap axis or line 72, which can be a centerline, defined by keycap 32 is selectively displaced from or misaligned with line 74 that is a common line defined by the indicator module 54 and the dome switch 60 which are physically aligned in the switch assembly of FIG. 3.

Operatively, the switch assembly 70 is actuated by an applied actuating force, schematically depicted by force arrow 76 in FIG. 4, which displaces keycap 32, in this operative example, and is directed along the line 72 thereof. The displaced keycap 32 transmits the actuating force 76 to the indicator module 54. However, the selected displacement or misalignment of the keycap 32 and the indicator module 54 decreases the total actuating force transmitted from the keycap to the indicator module by a predetermined amount.

In the vector analysis as schematically illustrated by FIG. 4, actuating force 76 is equal to a resultant force vector $f_R$ which is the sum of vertical force vector $f_V$ and horizontal force vector $f_H$. Because of the displacement of line 74 from line 72, the generation of horizontal force vector $f_H$ decreases the transmitted actuating force, schematically depicted by force arrow 78, to an amount equal to the vertical force vector $f_V$. For example, where actuating force 76 has a unit value of 4, the vertical force vector $f_v$ can have a unit value of 2.5; the unit value of force 78 dependent for the most part upon the total displacement between the lines 72 and 74. The actuating force 76 can be further decreased by varying keycap proportions and switch panel 14 configurations. For example, in FIG. 5, switch assembly 80 has misaligned lines 72 and 74 as in the switch assembly 70 of FIG. 3; the keycaps 82 and 84 formed in the keypad 86, and the switch panel 88, however, are configured to decrease the amount of a transmitting force applied to the keycaps.

In FIG. 5, keycap 82 is formed in the keypad 86 so that the keycap extends outwardly through key aperture 90 with an exposed actuating surface 92 that is flush with aperture rim 94 formed in the switch panel 88. Where an actuating force is applied to the exposed actuating surface 92 by an operator's finger, the aperture rim 94 is properly sized so that the operator's finger is restricted by the aperture rim during compression-depression of the keycap 82 to actuate switch 60 to limit the total amount of actuating force applied to the keycap.

Similarly, keycap 84 of switch assembly 80 as shown by FIG. 5 extends outwardly into key aperture 98 with an exposed actuating surface 100. The exposed actuating surface 100 is recessed below an aperture rim 102 formed in the switch panel 88. The recessed portion of the actuating surface 100 of the keycap further impairs accessability of the operator's finger during compression-depression of the keycap 84.

Referring to FIG. 6, another form of switch assembly 110 of the invention has a keycap axis or line 114 defined by dome switch 60 that it is selectively displaced from or misaligned with line 74 which, as shown by FIGS. 3 and 5 as described hereinbefore, is displaced from or misaligned with line 72. This selected displacement or misalignment of lines 72, 74, and 114 further decreases the total actuating force transmitted from an activated keycap, here keycap 82, through an indicator module 54 and cushion 20 to dome switch 60 by a predetermined amount which is selectively determinable as described hereinbefore.

Additional reduction in the total actuating force transmitted through any of the switch assemblies 70, 80, and 110 of the invention as described and shown by respective FIGS. 3, 5, and 6 can be realized by a keypad having the exposed actuating surfaces of the keycaps formed in selected configuration as shown by FIG. 7. One form of keypad 120 as shown by FIG. 7 is formed from a transparent, flexible elastomer material. The keypad provides (1) a plurality of keycaps 122, 124, 126, and 128 that are molded at selected locations so that the keycaps coincide with respective apertures in a switch panel, such as the switch panel 88 of FIG. 5; (2) a one-piece element with the keycaps formed to desired human-factors features such as size, shape, visual, and response characteristics as described in more detail hereinafter; and (3) a dust and hermetic sealing mechanism — that is disclosed in the above-mentioned patent application Ser. No. 585,203 filed June 9, 1975 to which reference is made and, while I conceived the invention disclosed in the aforementioned patent application and the present invention, the present invention is directed to the switch assembly having selective actuation sensitivity as herein described and shown.

Among the several control features that can be realized by the keypad 120 of FIG. 7 are the following:

A. Symbolic shape — designing and shaping one or more keycaps to visually represent functional tasks such as in a flow diagram, or as pictorial shapes; for example, triangular keycap 126.

B. Nomenclature — permanent nomenclature can be molded into individual keycaps, then filled with a desired material such as an opaque material, and cured; for example, keycap 128 with its word MORE.

C. Blind feel — shaping keycaps so that desired keycaps have a distinct, individual "feel" when touched during switch actuation by the fingertips of a human operator; for example, keycap 122 with its outwardly directed knife edge 130; or keycap 124 with either its concave or convex, as desired, exposed actuating surface 132.

D. Sensitivity which provides an additional reduction in the total actuating force transmitted through the keypad and its keycaps; here keypad 120 and keycaps 122, 124, 126, and 128 of FIG. 7

1. varying the proportion between keycap thickness and width such keycaps 82 and 84 as described and shown by FIG. 5;
2. varying keycap proportions and switch panel configurations such as keycap 84 and its aperture rim 102; and
3. shaping the exposed outer surfaces, such as surfaces 130 and 132 of respective keycaps 122 and 124 of FIG. 7.

As will be evidenced from the foregoing description, certain aspects of the invention are not limited to the particular details of construction as illustrated, and it is contemplated that other modifications and applications will occur to those skilled in the art. It is therefore, intended that the appended claims shall cover such modifications and applications that do not depart from the true spirit and scope of the invention.

I claim:

1. A switch assembly comprising:

a. force transmitting means displaceable from a first non-actuation switch position to a second actuating switch position by an actuating force directed along a force transmitting line defined by the centerline of said force transmitting means, b. flexible indicator means for display of indicia, said flexible indicator means having a centerline defining a force transmitting line, and displaceable by said force transmitting means, c. said flexible indicator means centerline misaligned with said force transmitting means centerline by a selected distance so that displacement of said transmitting means by the actuating force displaces said indicator means, and said misaligned centerline reducing the transmitted actuating force by a first determinable portion, and d. switch means operable by said reduced actuating force.

2. The switch assembly of claim 1 in which said flexible indicator means includes a resilient means absorbing a first portion of the reduced actuating force displacing said indicator means and transmitting a second portion of the reduced actuating force.

3. The switch assembly of claim 2 in which said switch means is operable by said second portion of the reduced actuating force.

4. The switch assembly of claim 1 in which said switch means defines a force transmitting centerline that is misaligned with said indicator means centerline by a selected distance, said misaligned indicator means and switch means centerlines reducing said reduced actuating force by a second determinable portion.

5. The switch assembly of claim 1 in which said force transmitting means are selectively transparent and said flexible means displays said indicia therethrough.

6. The switch assembly of claim 1 in which said switch means defines a force transmitting centerline that is aligned with said indicator means centerline.

* * * * *